United States Patent [19]

Hanyu et al.

[11] Patent Number: 4,861,327

[45] Date of Patent: Aug. 29, 1989

[54] ZIGZAG FOLDING APPARATUS FOR A FORM PRINTING MACHINE

[75] Inventors: Akinobu Hanyu; Tsukasa Kurokawa, both of Higashihiroshima, Japan

[73] Assignee: Fuji Kikai Kogyo Co., Ltd., Hiroshima, Japan

[21] Appl. No.: 114,806

[22] Filed: Oct. 29, 1987

[51] Int. Cl.[4] ..... B41L 1/32

[52] U.S. Cl. ..... 493/415; 270/39

[58] Field of Search ..... 493/413, 414, 415, 430; 270/39

[56] References Cited

U.S. PATENT DOCUMENTS 4,030,720 6/1977 Jones ..... 493/12
4,623,136 11/1986 Bunch, Jr. ..... 270/39 X

FOREIGN PATENT DOCUMENTS 0050865 5/1982 European Pat. Off. .
0190749 8/1986 European Pat. Off. .
1590942 4/1970 France .
2258338 8/1975 France .

*Primary Examiner*—Eugene R. Laroche
*Assistant Examiner*—Robert J. Pascal
*Attorney, Agent, or Firm*—Jordan and Hamburg

[57] ABSTRACT

A zigzag folding apparatus for a form printing machine has a guiding device for paper feeding disposed in the front end thereof, folding arms for holding paper form blanks in a zigzag along their respective transversely perforated lines through rightward and leftward swing movements thereof effected by crank shafts, and a plurality of rotary spirals for arranging the paper blanks folded by the folding arms in a pile through guiding along the fold lines of the same. Particularly, the crank shafts are connected via a rotating transmission mechanism of gearing to a servo motor for folding drive which is controlled with control signals. Additionally, the apparatus has a device for rightward and leftward positioning of said rotary spirals in accordance with a folding top-to-bottom length of the paper blank, a device for positioning the same in directions at right angles to the rightward and leftward directions in accordance with a lateral width of the paper blank, and motors for folding top-to-bottom length determining and lateral width determining respectively whcih are controlled with control signals.

11 Claims, 5 Drawing Sheets

ZIGZAG FOLDING APPARATUS FOR A FORM PRINTING MACHINE

BACK GROUND OF THE INVENTION AND RELATED ART STATEMENT

The present invention relates to a zigzag folding apparatus for a form printing machine for printing and processing business forms.

The form printing machine consists of a paper supply section, a printing section, a processing section including a punching device and a transverse perforating device, and the zigzag folding apparatus.

In a known form printing machine, each of the paper supply section, printing section, processing section, and zigzag folding apparatus is driven by a drive means having a single motor. To control the drive of the zigzag folding apparatus, the speed-change gears are employed which require some operations of shifting, etc.

Additionally, on the zigzag folding apparatus, paper form blanks are folded in a zigzag along the transversely perforated lines arranged therein by means of the rightward and leftward swing movements of folding arms and then arranged in a pile upon being folded up by rotary spiral members which is required to adjust for positioning in accordance with a change in folding length and width of the forms. However, in the prior art this adjustment has been made non-automatically without the use of an NC control, which is disadvantageous in producting various sizes of the forms.

It is therefore an object of the present invention to provide a zigzag folding apparatus in which the aforesaid problem is eliminated.

The other objects and advantages of the invention will be apparent from the following description.

SUMMARY OF THE INVENTION

The present invention is directed towards a zigzag folding apparatus comprising a guiding device for feeding paper disposed in the front end thereof, folding arms for folding paper form blanks in a zigzag along their respective transversely perforated lines through rightward and leftward swing movements thereof effected by crank shafts, and a plurality of rotary spirals for arranging the paper blanks folded by the folding arms in a pile through guiding along the fold lines of the same. Particularly, the crank shafts are connected via a rotating transmission mechanism of gearing to a servo motor for folding drive which is controlled with the use of control signals.

This arrangement will eliminate the customary operation of changing shift-gears thus to facilitate the adjustment.

Additionally, according to the present invention, a device for rightward and leftward positioning of the rotary spirals in accordance with a folding top-to-bottom length of the paper blanks and a device for positioning the same in directions at right angles to the rightward and leftward directions are provided, which positioning devices are driven by their respective motors for folding top-to-bottom length determining and lateral width determining. Particularly, the motors for folding top-to-bottom length determining and lateral width determining respectively are controlled with control signals.

This arrangement will also facilitate to shift the operation for fabricating products which may vary in length and width and therefore, minimize a time of set-up operation and energy consumption thus to provide high efficiency of production.

DETAILED DESCRIPTION OF PREFERRED EMBODIMENT

Figure 1:
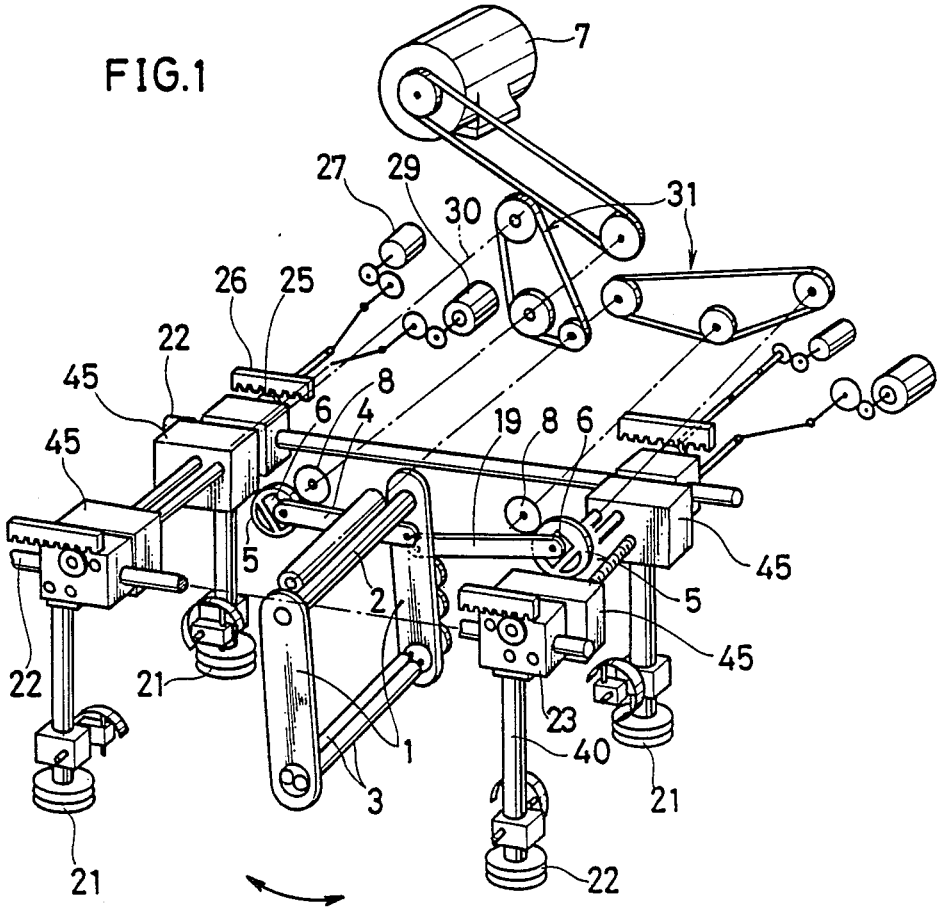
FIG. 1 is a perspective view illustrating a main section of one preferred embodiment of the present invention.
Figure 2:
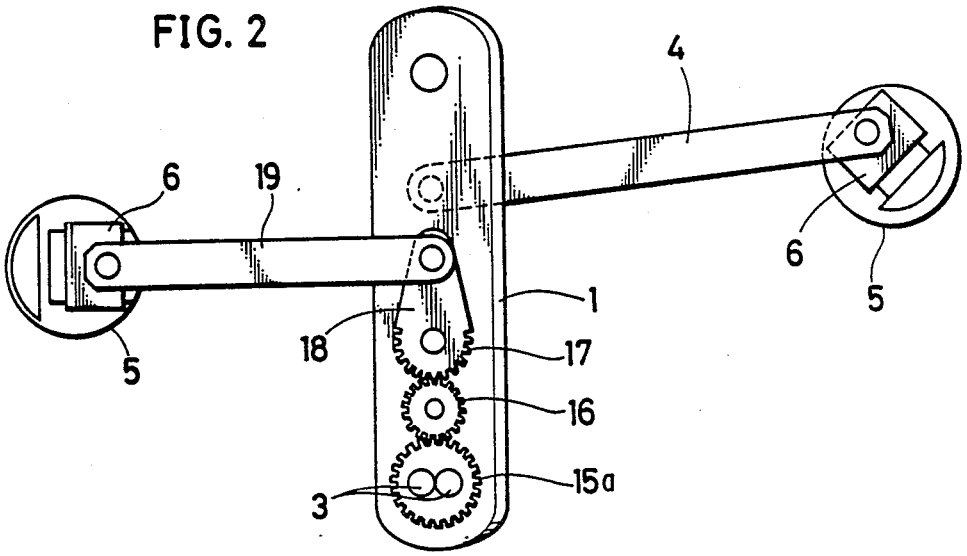
FIG. 2 is a front view of a folding arm section of the same.
Figure 3:
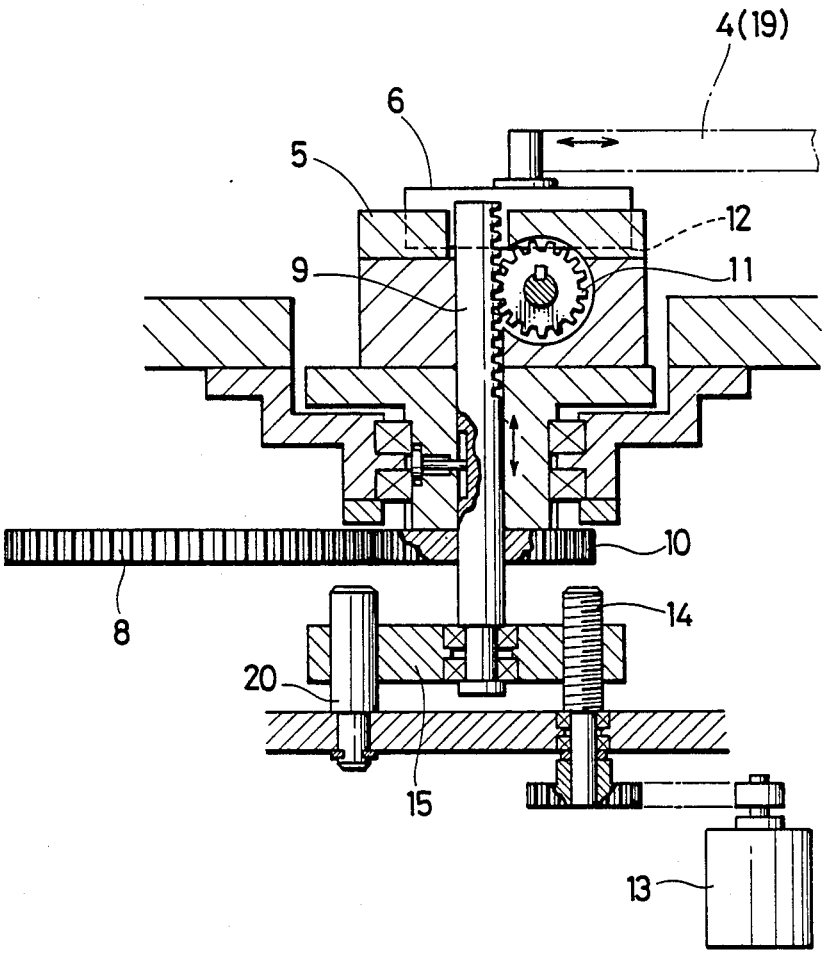
FIG. 3 is a cross-sectional view illustrating a mechanism for adjusting a swing angle on the folding arm and an angle on the paper infeed rolls.

One preferred embodiment of the present invention will be described in conjunction with the accompanying drawings. As shown in FIGS. 1 and 2, the numeral 1 is a folding arm which moves rightwards and leftwards (in the top-to-bottom lengthwise direction) in a swing motion about a swing-center axle 2 disposed in the upper end thereof. The folding arm 1 has at lower end a pair of paper infeed rolls 3 mounted rotatably thereto so that a swing angle on the rolls can be changed. The numeral 4 is a link member connected at one end with the folding arm 1. The link 4 is connected at the other end thereof with an eccentrically movable cam 6 thus to cause the swing motion of the folding arm 1. The cam 6 is mounted to a rotary disk 5 so as to be eccentrically movable about a rotating center of the rotary disk 5. Accordingly, the link 4 performs crank actions with the movements of the rotary disk 5 and cam 6 thus to cause the swing movements of the folding arms 1 which is effected in a determined length of stroke and in accordance with an amount of eccentricity on the cam 6. The rotary disk 5 is driven by a servo motor 7 for folding drive. In the drive arrangement, as shown in FIG. 3, the rotating power from the folding drive servo motor 7 is transmitted via gear members 8 and 10 to a rack shaft 9 on which the rotaty disk 5 is securely mounted. The eccentricity adjusting mechanism of the cam 6 is shown in FIG. 3 having a rack 12 disposed on the back face of the cam 6 and a pinion 11 which is rotatably mounted on an axle in the rotary disk 5 thus to mesh with the rack 12, so that the cam 6 can be moved eccentrically by means of the pinion 11 through the axial displacement of the rack shaft 9. In the mechanism for the axial movement of the rack shaft 9, an operative plate 15 is mounted on the rear end of the rack shaft 9 in relatively rotatable relationship while a guide pin 20 is secured to a fixed member so as to permit the axial movement of the rack shaft 9 and restrict the rotating movement of the same. Additionally, the operative plate 15 is threaded on a screw 14 arranged rotatably in bearing engagement with the fixed member so that the rack shaft 9 can move in the axial direction together with the operative plate 15 as the screw 14 rotates in the forward and reverse directions. The screw 14 is driven for the forward and reverse rotating movements by a motor 13 operating with a control signal. Accordingly, a determined length of swing stroke on the swing arm 1 can be automatically adjusted by the drive of the motor 13.

The swing angle adjusting mechanism of the paper infeed rolls 3 will be described below. As shown in FIG. 2, gears 15*a* and 16 for rotating the paper infeed rolls 3 and a lever 18 provided with a gear 17 meshing with the gear 16 are mounted to the swing arm 1. The lever 18 is connected with the end of a link 19, the link 19 having at the other end the same arrangement as the aforesaid combination of the rotary disk 5 connected with the end of the aforesaid link 4, the cam 6, and the eccetricity adjusting mechanism of the cam 6. While the link 19 moves in crank motions as being synchronized with the link 4, the eccentric movement of the cam 6 is transmitted via the lever 18 and the gears 17, 16, 15 thus to adjust automatically the paper infeed rolls 3 to have a desired swing angle. The paper infeed rolls 3 may be replaced with guide plates.

Figure 4:
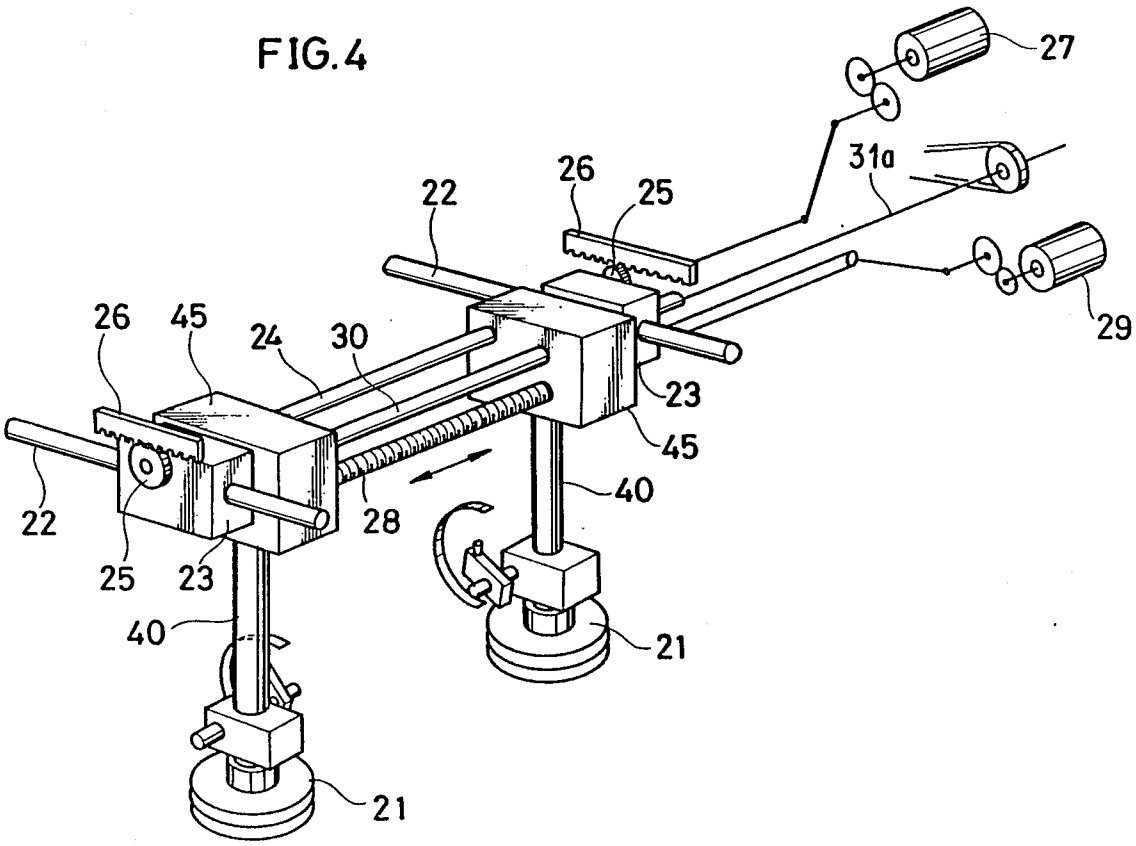
FIG. 4 is a perspective view illustrating a mechanism for determining a folding top-to-bottom length and a lateral width of the paper form blank.
Figure 5:
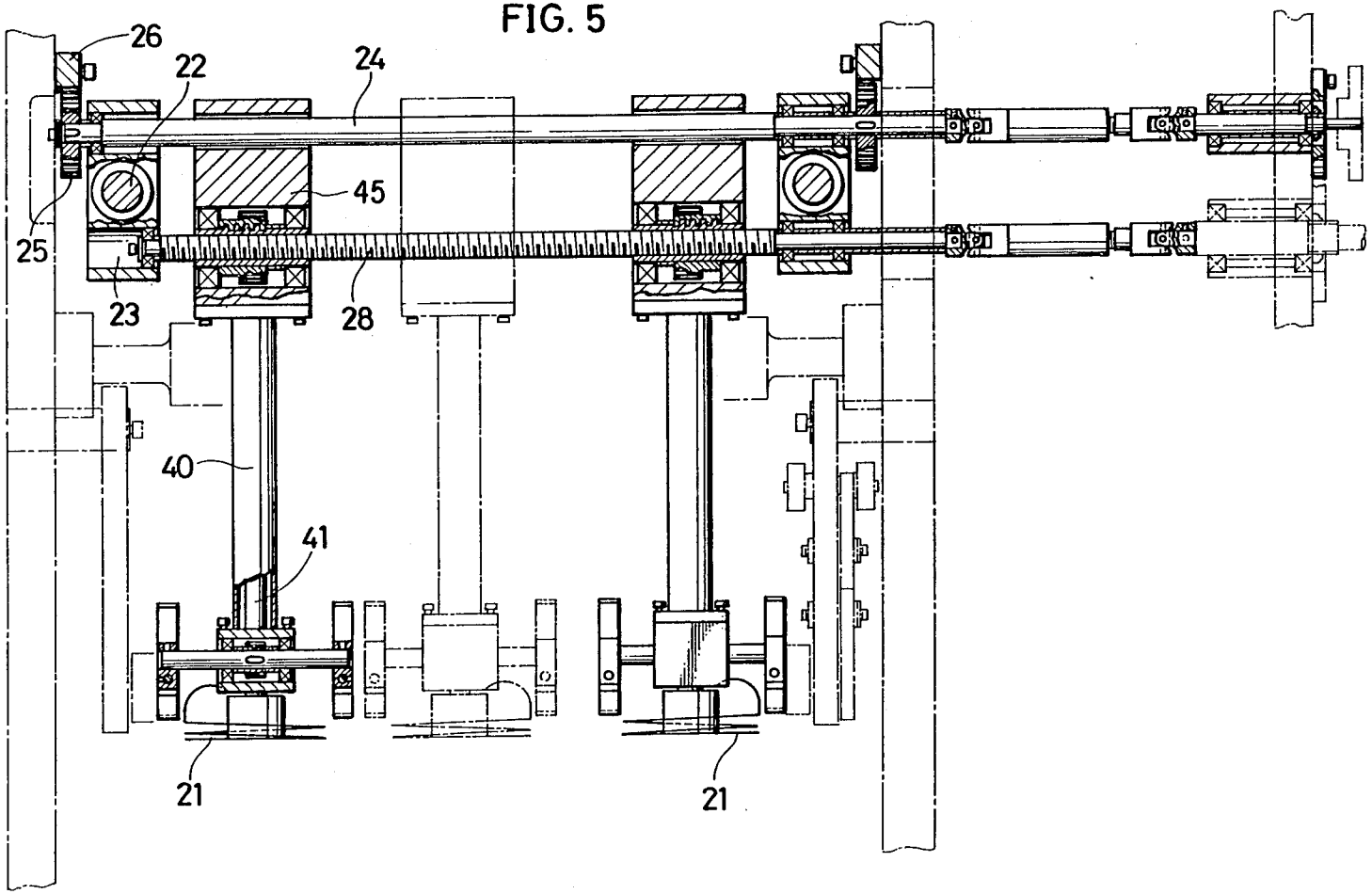
FIG. 5 is a cross-sectional view of the mechanism in FIG. 4.

The numeral 21 is a rotary spiral member, a plurality of which are disposed for the operation in which paper form blanks folded primarily in a zigzag by the swing arms 1 along the transversely perforated lines arranged therein are arranged in a pile upon being folded up. The rotary spirals 21 are also arranged in a mechanism in which the automatic control thereof can be made as corresponding to the folding top-to-bottom length and lateral width of a paper form. This mechanism will be described in conjunction with FIGS. 1, 4, and 5. In the mechanism, block members 23 are slidably mounted on a pair of guide shafts 22 extending in the rightward and leftward directions or folding top-to-bottom lengthwise directions, and between two of the blocks 23, a drive shaft 24, a lead screw shaft 28, and a spline shaft 30 in parallel relationship are arranged rotatably in bearing engagement with the blocks 23. The drive shaft 24 has at both ends pinions 25 secured thereto, each of which meshes with a rack 26 mounted to a fixed member. Each of the blocks 23 can travel on the guide shaft 22 as the drive shaft 24 rotates together with the pinion 25 on the rack 26.

The lead screw shaft 28 has a support block 45 mounted with a nut threaded thereon. A pipe 40 extending perpendicularly is attached downwardly to the support block 45 and the rotary spiral 21 is mounted to the lower end of a rotating shaft 41 extending through the pipe 40. The rotating shaft 41 extending through the pipe 40 has at upper end a helical gear which is meshed with another helical gear mounted in spline engagement with the spline shaft 30, as not shown, so that the rotary spiral 21 can rotate as the spline shaft 30 rotates. The drive power for rotating the spline shaft 30 is transmitted along a rotating axis 31*a* from the aforesaid folding drive servo motor 7 via a transmitting mechanism 31 (See FIG. 1).

The drive shaft 24 is driven by a motor 27 for determining the folding top-to-bottom length while the lead screw shaft 28 is driven by a motor 29 for determining the lateral width. Both the motors 27 and 29 for respective length and width determining can be controlled with the use of control signals for their respective forward and reverse rotating movements. Accordingly, through operating the folding top-to-bottom length determining motor 27, the rotary spirals 21 can be located automatically in position relative to the folding top-to-bottom length as the blocks 23 moves in the rightward and leftward (folding top-to-bottom lengthwise) directions, and at the same time, through operating the width determining motor 29, the rotary spirals 21 can be moved automatically for the widthwise positioning as the support blocks 45, in one side or both sides, move in the axial directions of the lead screw shaft 28 or widthwise directions on the lead screw shafts 28 driven.

What is claimed is:

1. Apparatus for folding paper in a zigzag manner along transverse fold lines comprising folding arm means which pivotably oscillate about a transverse axis to guide said paper to effect folding of said paper in a zigzag manner, link means connected to said folding arm means, a motor drive, operable means operably connected between said motor drive and said link means such that rotation of said motor drive effects said pivotal oscillation of said folding arm means, said folding arms having an oscillating stroke determined by the extent of pivotal oscillation of said folding arms, adjusting means incorporated in said operable means for adjusting said oscillating stroke, rotary spiral drive means, and rotary spiral means driven by said rotary spiral drive means for receiving said paper from said folding arm means and arranging the folded paper in stacked array.

2. Apparatus according to claim 1, wherein said motor drive is designated a first motor drive, said adjusting means comprising a second motor drive which is rotatable to adjust said oscillating stroke.

3. Apparatus according to claim 2, wherein said adjusting means comprises a rotary disk, an eccentric member carried by said rotary disk, said link means being connected to said eccentric member, and a gear wheel operably connected to said eccentric member and rotatable to change the position of said eccentric member relative to said rotary disk.

4. Apparatus according to claim 3, wherein said adjusting means further comprises a rack shaft having a longitudinal axis, said rack shaft meshing with said gear wheel and being movable along said longitudinal axis to effect rotation of said gear wheel, and rotary-linear means connected to said rack shaft and having a rotary driven member such that rotation of said rotary driven member moves said rack shaft linearly along said longitudinal axis, said second motor drive driving said rotary driven member.

5. Apparatus according to claim 4, wherein said rotary-linear means comprises a first threaded member rotatably driven by said rotary driven member, and a second threaded member connected to said rack shaft, said first threaded member being threaded to said second threaded member.

6. Apparatus for folding paper in a zigzag manner along transverse fold lines comprising folding arm means which pivotably oscillate about a transverse axis to guide said paper to effect folding of said paper in a zigzag manner, link means connected to said folding arm means, a motor drive, operable means operably connected between said motor drive and said link means such that rotation of said motor drive effects said pivotal oscillation of said folding arm means, said folding arms having an oscillating stroke determined by the extent of pivotal oscillation of said folding arms, said folding arm means comprising an elongated arm and paper guide means mounted on said arm, said folding arm means further comprising guide adjusting means for adjusting the angle of same paper guide means relative to said arm, said guide adjusting means comprises a rotary-lever means mounting on said arm for rotatably adjusting said angle of said paper guide means, rotary spiral drive means, and rotary spiral means driven by said rotary spiral drive means for receiving said paper from said folding arm means and arranging the folded paper in stacked array.

7. Apparatus according to claim 6, further comprising first adjusting means incorporated in said operable means for adjusting said oscillating stroke, and second adjusting means incorporated in said rotary-lever means to provide for automatic adjustment of said angle of said paper guide means in accordance with the adjustment of said oscillating stroke.

8. Apparatus according to claim 7, wherein said rotary-lever means comprises a lever having one end with gear teeth, said rotary-lever means further comprising a link member pivotably connected to the other end of said lever, said rotary-lever means further comprising a gear wheel means engaging said gear teeth on said lever and operatively connected to said paper guide means, said lever being pivotably mounted on said arm such that pivotal movement of said lever by said link member adjusts said angle of said paper guide means.

9. Apparatus for folding paper in a zigzag manner along transverse fold lines comprising folding arm means which pivotably oscillate about a transverse axis to guide said paper to effect folding of said paper in a zigzag manner, link means connected to said folding arm means, a motor drive, operable means operably connected between said motor drive and said link means such that rotation of said motor drive effects said pivotal oscillation of said folding arm means, said folding arms having an oscillating stroke determined by the extent of pivotal oscillation of said folding arms, and rotary spiral means receiving said paper from said folding arm means and arranging the folded paper in stacked array, said rotary spiral means comprising a first pair of spaced spiral supports spaced from one another in a transverse direction and a second pair of spiral supports also spaced from one another in said transverse direction with said first pair being spaced from said second pair in a longitudinal direction perpendicular to said transverse direction, the first said motor drive being designated a first motor drive, and further comprising a second motor drive operatively connected to said first and second pair of spiral supports to move said first and second pair of spiral supports in said transverse direction to change the transverse spacing between said first and second spiral supports, and a third motor drive operably connected to said first and second pair of spiral supports to move said first and second pair of spiral supports in said longitudinal direction to change the longitudinal spacing between said first and second pair of spiral supports.

10. Apparatus according to claim 9, wherein each of said spiral supports comprises a block means, a first drive shaft means extending from said block means, spiral devices on said first drive shaft means, a second drive shaft means extending from said block means for driving said first drive shaft means and a fourth motor drive for driving said second drive shaft means to rotate said spiral devices.

11. Apparatus according to claim 9, wherein each of said spiral supports comprises a block means, a first shaft means extending between the two block means associated with each pair of spiral supports, said first shaft means being driven by said second motor drive, a second shaft means extending between one block means associated with said first pair of spiral supports and another block means associated with said second pair of spiral supports, said block means being slidable on said second shaft means, said second shaft means being perpendicular to said first shaft means, a gear rack extending parallel to said second shaft means, gear wheels rotatably mounted on such block means and meshing with said gear rack, and a fourth shaft driving said gear wheels to thereby move said block means in said longitudinal direction, said fourth shaft being driven by said third motor drive.

* * * * *